United States Patent [19]

Sartor

[11] 4,440,247

[45] Apr. 3, 1984

[54] ROTARY EARTH DRILLING BIT

[76] Inventor: Raymond W. Sartor, 112 Hackberry, Red Oak, Tex. 75154

[21] Appl. No.: 372,898

[22] Filed: Apr. 29, 1982

[51] Int. Cl.[3] ..... E21B 10/60

[52] U.S. Cl. ..... 175/393; 175/403; 175/387

[58] Field of Search ..... 175/393, 403, 404, 387, 175/391, 330

[56] References Cited

U.S. PATENT DOCUMENTS

| | | | |
|---|---|---|---|
| Re. 26,669 | 9/1969 | Henderson | 175/330 |
| 3,059,708 | 10/1962 | Cannon et al. | 175/393 |
| 3,099,324 | 7/1963 | Kucera et al. | 175/339 |
| 3,163,245 | 12/1964 | York | 175/408 |
| 3,180,440 | 4/1965 | Bridwell | 175/393 |
| 3,220,497 | 11/1965 | Mori | 175/393 |
| 3,298,451 | 1/1967 | Eckel et al. | 175/393 |
| 3,693,735 | 9/1972 | Cortes | 175/329 |
| 4,073,354 | 2/1978 | Rowley et al. | 175/391 |

OTHER PUBLICATIONS

"Recent Developments in Stratapax Blank Bits", Offenbacher, L. A., presented at the ASME Petroleum Mechanical Engineering Conference, Tulsa, OK, Oct. 28–30, 1979.

*Primary Examiner*—Ernest R. Purser
*Assistant Examiner*—Thuy M. Bui
*Attorney, Agent, or Firm*—Richards, Harris & Medlock

[57] ABSTRACT

A blade-type rotary drill bit having radially divergent cutting blades arranged in two arrays and equipped with cutting blanks having upset cutting surfaces formed of an abrasive material such as diamond or the like. The blades in one array cut to the center of the bit to provide a conically shaped core volume and the blades of the second array terminate short of the axis of the bit to define a somewhat larger core volume. The bit is equipped with discharge ports and baffles whereby drilling fluid issuing from the discharge ports moves downwardly and then inwardly to the center of the bit. The cutting blanks located on the second array of blades cut in a common set of tracks which are at least partially different from and compliment the tracks cut by the cutting blanks on the blade of the first array.

24 Claims, 5 Drawing Figures

ROTARY EARTH DRILLING BIT

DESCRIPTION

1. Technical Field

This invention relates to rotary earth drilling bits and more particularly to new and improved blade-type rotary drag bits.

2. Background of the Invention

Typically, wells are drilled into the earth's crust to desired subterranean locations, e.g., oil and/or gas bearing formations, water zones, and geothermal formations, through the application of rotary drilling techniques. In the rotary drilling of a well, a drilling fluid is circulated downwardly through the drill string and into the borehole through one or more ports located in the drill bit at the end of the drill string. The drilling fluid then moves upwardly through the well annulus surrounding the drill string to the surface of the well. The drill cuttings formed by the bit at the bottom of the well are circulated to the surface with the drilling fluid.

The systems employed in rotary drilling operations fall generally into two categories. In one system, the rotary action is imparted to the drill bit by rotating the drill string with a suitable power source at the surface of the hole. For example the drill string may be suspended from a rotary table on the rig floor which is driven by a prime mover to impart torque to the drill pipe. In the other case, the drill bit is rotated by means of a downhole drill motor which usually is hydraulically actuated. In this case, the drilling fluid is used to power a turbine motor located at the bottom of the drill string. The drill bit is connected to the rotor of the turbine and thus is driven with a force which is proportional to the pressure drop across the mud turbine.

The two principal types of drill bits which are employed in rotary drilling operations are roller bits and drag bits. In roller bits, rolled cones, usually three in number, are mounted on the bottom of the bit so that as the bit is rotated the cutting teeth of the cones roll along the bottom of the borehole. In this case the rock or other earth material at the bottom of the borehole is broken up primarily by compressive stresses. In the drag-type bits, the cutting surfaces on the bit act to cut through the earth material in an abrading action and failure of the earth material is primarily by shear.

The action of the drilling mud is important in the operation of both types of bits and it functions similarly in some respects and dissimilarly in others. For example, in both roller bits and drag bits, the drilling mud functions to cool the bit and to transport the drill cuttings to the surface of the well. In the roller-type bits, which as noted previously, operate to cause rock failure in compression, it is important to rapidly remove the cuttings from the vicinity of the bit so that the crushing action of the bit is directed against the rock face and not against previously formed cuttings. It is also important to prevent the cuttings from accumulating above the roller cones so that they "ball up" and do not turn freely. Thus, U.S. Pat. No. 3,099,324 to Kucera et al discloses a tri-cone roller bit in which drilling fluid from the interior of the bit passes downwardly through a plurality of fluid discharge passageways which are located between the roller cones near the periphery of the bit. The drilling fluid is discharged downwardly near the wall of the borehole and thence upwardly through a plurality of return passageways which extend from the interior to the exterior of the bit through the bearing extensions on which the cutters are mounted. The return passageways are located adjacent the upper outer portions of the roller cutters so as to prevent the accumulation of cuttings in the area above the roller cutters, thus avoiding the "balling up" condition.

The circulation of drilling fluid through drag bits is also of significance in their operation although somewhat different considerations apply. For example, U.S. Pat. No. 3,180,440 to Bridwell discloses a blade-type drag bit in which bit stability is improved by employing a stepped blade configuration in combination with drilling fluid discharge nozzles mounted near the gauge edges of the blades. The cutting blades of the Bridwell bit are stepped across the bottom to provide a stepped core below the bit body which assists in centering the bit in the borehole. The drilling-fluid discharge nozzles are mounted in laterally projecting pads in front of the blades and oriented so that the drilling fluid impinges against the formation near the lower gauge corner of each blade. This reduces entrapment and regrinding of cuttings between the gauge surfaces and the wall of the well, thus reducing wear and also the accumulation of cuttings adjacent the upper sections of the blades with the attendant tendency of the bit to "ball up".

U.S. Pat. No. 3,693,735 to Cortes discloses a matrix-type drag bit which is divided into eight sectors delineated by four small-diameter grooves and four large-diameter grooves. The grooves extend radially from the center of the bit and terminate in recesses at the periphery of the bit. Each of the sections are provided with diamond-studded cutting blocks which are arranged such that debris from the drilling action is distributed so that it reaches the grooves where it may be carried outwardly to the recesses by action of the drilling fluid.

DISCLOSURE OF THE INVENTION

In accordance with the present invention, there are provided a new and improved drag-type rotary earth drilling bits having enhanced stability and drilling fluid distribution characteristics. In one aspect of the invention, there is provided a drill bit comprising a body portion adapted to be secured to a rotary drill member and a plurality of wedge-shaped radially divergent cutting blades which depend from the body portion. The inner edges of the blades taper upwardly and inwardly from their tips to converge at the axis of the bit. The blades are provided with a plurality of cutting blanks along their inner and outer edges. The cutting blanks have cutting surfaces which are upset relative to the blade surfaces. The drill bit further comprises flow passageway means which provides for fluid communication between the bottom of the body portion of the bit at the convergence of the blades and the top of the bit. A plurality of drilling fluid supply passageways extend downwardly through the body member and terminate in ports at locations radially offset from the axis of the bit. Thus, drilling fluid discharged from the ports flows downwardly along the outer edges of the blades and thence inwardly to the convergence of the blades and the fluid communication means. Preferably the bit comprises baffle means extending downwardly from the body portion and interposed between the discharge ports and the convergence of the blades. It is also preferred to provide the bit with an annular baffle above the ports which has substantially the same gauge as the cutting gauge of the bit.

In a further aspect of the invention, a drag bit is provided which incorporates first and second arrays of radially divergent blades which depend from the body portion of the bit. The blades in the first array have outer edges which taper upwardly and outwardly from their tips to the periphery of the bit and inner edges which taper upwardly and inwardly and converge at the axis of the bit to define a conically shaped core volume at the bottom of the bit. The blades in the second array are interposed between the blades of the first array and have outer edges which conform generally to the outer edges of the blades in the first array. The inner edges of the blades in the second array terminate at locations radially spaced from the axis of the bit to define a core volume which is greater than the core volume defined by the first array of blades. The blades in each of the arrays are provided with cutting blanks having upset cutting surfaces and which are oriented at a side-rake angle relative to the blades. The cutting blanks on the first-array blades are spaced along both the outer and inner edges of the blades and the cutting blanks on the second-array blades are spaced along the outer edges and tips of the blades. At least some of these latter cutting blanks are oriented at a side rake angle which is opposed to the side rake angle of the corresponding cutting blanks on the blades in the first array.

In yet a further embodiment of the invention, there is provided an earth-drilling bit having a first array of radially divergent blades and a second array of radially divergent blades interposed between the blades of the first array and having conforming shapes as described above. Thus the blades in the first array define a conically shaped core volume at the bottom of the bit and the blades in the second array define a larger core volume. Cutting blanks located along the outer and inner edges of the first-array blades cut in a common set of tracks and the cutting blanks located along the outer edges and tips of the second array blades cut in a second common set of tracks which are at least partially different from and compliment the tracks cut by the blanks in the first array. The bit is further provided with radially offset drilling-fluid supply ports and baffle means interposed between these ports and fluid communication means provided at the convergence of the first array blades.

BEST MODES FOR CARRYING OUT THE INVENTION

Figure 1:
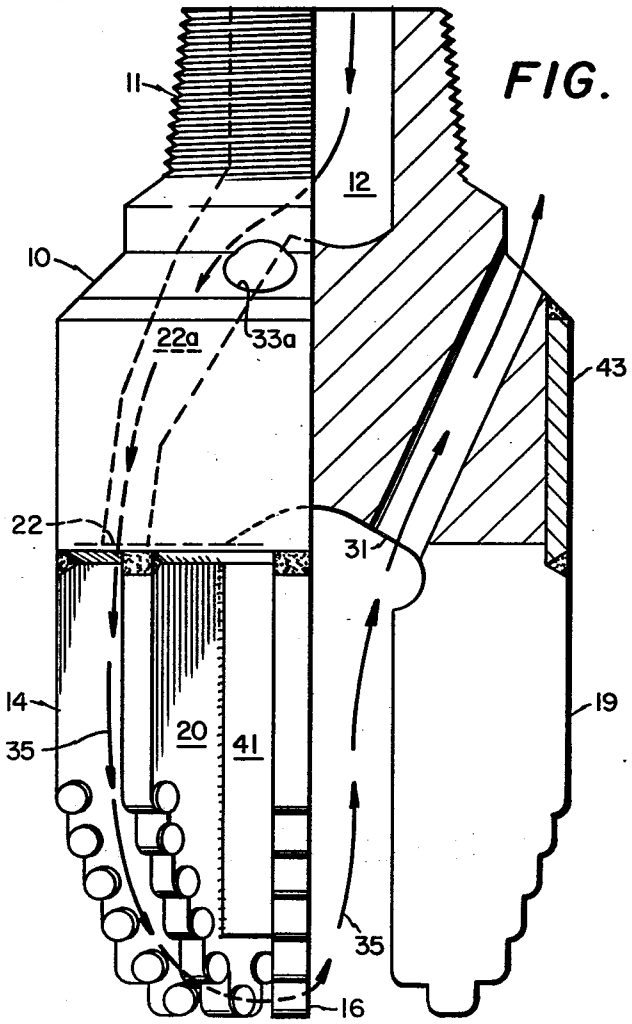
FIG. 1 is a side elevation with parts broken away to show the discharge and return of drilling fluid in a rotary drag bit embodying the present invention.

In the construction of drag bits, it is a conventional practice to form the cutting surfaces of the bit of a material which is much more abrasion resistant than the steel which forms the basic structural portion of the bit. Perhaps the best example of such construction is found in diamond bits in which small diamond particles are embedded in the matrix of either core bits or full-bore bits. Similar features may also be employed in the blade-type drag bits which are comprised of a plurality of radially extending blades. Blades-type drag bits such as fishtail bits and the like are most commonly used in drilling through relatively soft formations. However, such bits can also be employed in hard rock formations by forming the cutting edges of the blades with abrasion-resistant inserts such as tungsten carbide inserts or by mounting diamond chips in a matrix material along the bottom of each blade. Abrasion-resistant cutting surfaces may also be mounted on the bottom of the blades through the use of cutting blanks which usually are cylindrical in shape and which have at least one abrasion-resistant cutting surface. One example of such cutting blanks are the cylindrical cutting blanks available from the General Electric Company under the trademark "Stratapax". These cutting blanks typically consist of a layer of polycrystalline diamond bonded to one end of a cylindrical tungsten carbide substrate slightly more than one-half inch in diameter and in length. Such diamond-tipped cutting blanks are described in Offenbacher L. A. "Recent Developments in Stratapax Blank Bits" presented at the ASME Petroleum Mechanical Engineering conference, Tulsa, Okla., Oct. 28–30, 1979.

As noted previously, drag bits may be employed in conjunction with downhole motors or in conjunction with the more conventional rotary drilling techniques where the drill pipe is rotated from the surface by a rotary table, power swivel, or the like. Drag bits have been most successfully used in conjunction with downhole motors where they rotate at a relatively high rate. For example, a downhole turbine drill may rotate the bit at a rate of about 2000 revolutions per minute whereas during rotary-table drilling, the bit may be rotated at a rate of about 100 revolutions per minute or less.

Where hydraulically driven downhole drill motors are employed, most of the pressure differential developed by circulation of the drilling mud in the hole is utilized in driving the motor. Thus the pressure differential across the drill bit itself is relatively low, leading to difficulty in consistently cleaning the cutting surfaces.

Another difficulty often encountered in the utilization of blade-type drag bits is "over drilling" wherein too much of the formation is cut by the cutting surfaces involved during each revolution of the drill bit. While this problem may occur during the use of downhole drill motors, it is particularly pronounced when the drill string is driven from the surface by a rotary table or the like due to the low revolutions per minute and a high penetration per revolution when drilling at a high penetration rate. For example, in drill bits using the Stratapax disks described above, a penetration exceeding one-half the diameter of the disk per revolution of the bit has been found to cause wear and cleaning problems on the bit head.

In the present invention, the above mentioned problems associated with blade-type drag bits are alleviated by a drag bit in which the blades are arranged in two arrays and in which the drilling fluid is controlled by baffles to provide a velocity flow along the cutting blanks which permits the drilling to proceed with a relatively low pressure drop across the bit. The relationship between the arrays of blades are such that the bit cuts in a double profile which leads to enhanced bit stability. The blades of the two arrays cut in common sets of tracks which are at least partially different and compliment each other. The danger of over drilling is reduced by each blade cutting a portion of the depth penetrated in each revolution.

Figure 2:
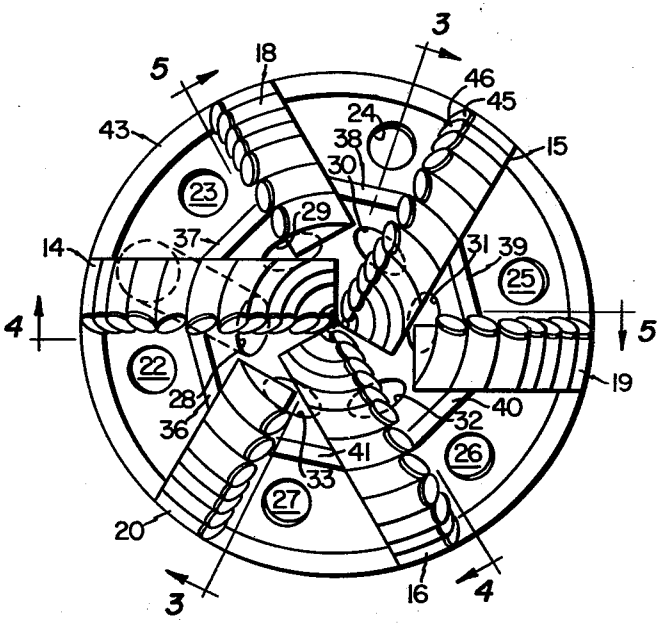
FIG. 2 is a bottom view of the drill bit shown in FIG. 1.

Turning now to FIG. 1 of the drawing, there is illustrated a side-elevational view with parts broken away of a blade-type drill bit constructed in accordance with the present invention. The drill bit comprises a body portion 10 from which depends a plurality of cutting blades, of which three are shown. The body portion includes a threaded pin 11 which is adapted to be connected to a drill member such as a rotary drill collar or a turbine rotor and which contains a central passageway 12 for the flow of drilling fluid. The cutting blades are arranged in two arrays as illustrated in FIG. 2, which is a bottom view of the bit illustrated in FIG. 1. As shown in FIG. 2, the first array comprises blades 14, 15 and 16 which cut substantially to the center of the borehole and the second array comprises blades 18, 19 and 20 which cut an annular ring within the borehole. As described in greater detail hereinafter blades 14, 15 and 16 are provided with cutting blanks spaced along the outer and inner edges of the blades and which cut in one set of tracks. Blades 18, 19 and 20 in the second array are provided with blanks which cut in a second set of tracks which are at least partially different from the first set, but which compliment the first set so as to reduce contact of the formation with the bit structure in which the blanks are mounted.

The drill bit is provided with a plurality of drilling-fluid supply passages which extend downwardly through the body member and terminate in ports 22 through 27 (shown in FIG. 2) which are radially offset from the axis of the bit and located near the periphery thereof. The bit is also provided with a plurality of return ports 28 through 33 which together with a central chamber area, described hereinafter, provide for fluid communication between the bottom of the body portion at the axis of the bit and the top of the bit. The bit further comprises baffle means extending downwardly from the body portion and interposed between the discharge ports and the convergence of the center cutting blades at the axis of the bit so that drilling fluid flow is directed downwardly along the edges of the blades and the cutting surface thereof. The flow of drilling fluid is indicated by arrows 35 in FIG. 1. As there illustrated, drilling fluid flows through the central passageway 12 within the pin section of the bit thence into passageway 22*a* and exits from port 22 in a downwardly and outwardly direction. The drilling fluid flows around baffle member 36 (FIG. 2) and thence to the interior of the bit where it passes upwardly through a passageway such as passageway 31.

As can be seen from an examination of FIG. 2, the flow path of the drilling fluid shown by the arrows 35 in FIG. 1 is repeated for each of the cutting blades as drilling fluid flows between discharge and return passages. The downwardly depending baffle means comprises baffle members extending between adjacent pairs of cutting blades. Thus in addition to the downwardly depending baffle member 41 shown in FIG. 1, there are also provided baffle members 36, 37, 38, 39, and 40 as shown in FIG. 2. These baffle members serve not only to direct the drilling fluid along the outer and inner edges of the cutting blades but also as strengthening ribs between adjacent blades.

In addition to the downwardly depending baffle means described above, the preferred embodiment of the invention also includes an annular baffle member 43 (shown in FIG. 1) which extends above the discharge ports 22 through 27 and is of substantially the same gauge as the cutting gauge of the bit. The annular baffle member serves to retard the direct flow of fluid from the outlet ports 22 through 27 upwardly into the well bore annulus around the outer periphery of the drill bit. The baffle member 43 also serves to centralize the bit in the hole, thus adding to bit stability. Preferably the annular baffle member 43 is formed of an abrasion resistant material such as tungsten carbide.

The cutting blanks on the blades preferably are at a positive back-rake angle, i.e., the downward angle the cutting blanks make with a horizontal plane normal to the face of the blade, within the range of about 15°–25°. The cutting blanks on the blades are also oriented at designated side-rake angles which preferably fall within the range of 15°–25°. By the term side-rake angle is meant the angle between the axis of the cutting blank and a vertical plane normal to the face of the blade. At least some of the cutting blanks on the blades of the second array are orientated at a side-rake angle which is the opposite of the side rake angle of the corresponding cutting blanks on the blades comprising the first array.

Figure 3:
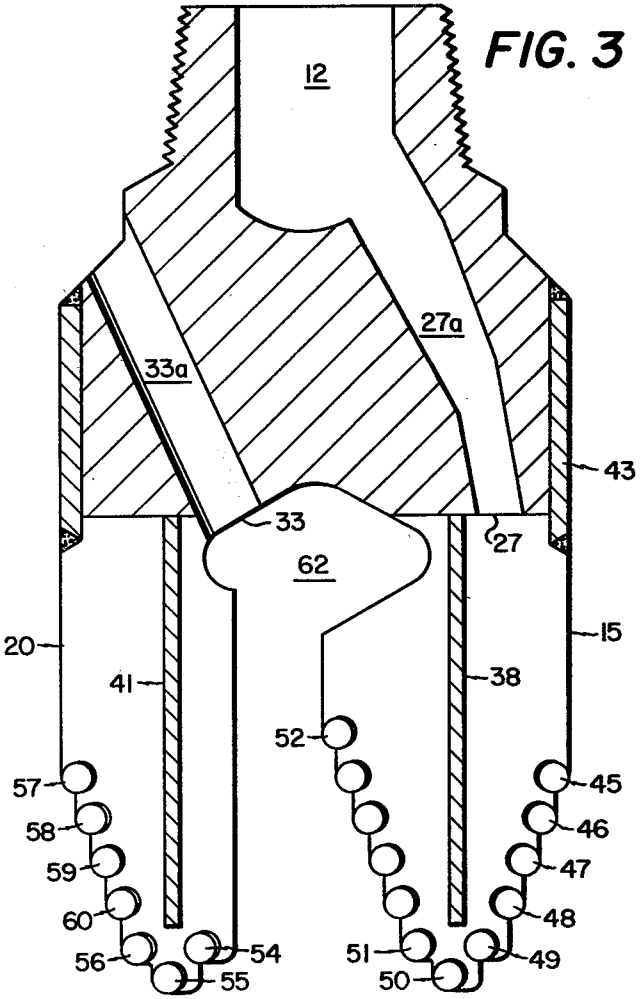
FIG. 3 is a sectional view with parts broken away taken along line 3—3 of FIG. 2.

The preferred relationship between the side rake orientation of the cutting blanks on the blades of the first array and the blades of the second array is illustrated in FIG. 3 which is a side view, partly in section, taken along line 3—3 of FIG. 2. The upper portion of the bit in FIG. 3 is shown in section to illustrate details of the drilling-fluid flow passageways. As shown in FIG. 3, the blade 15 which cuts to the center of the bit comprises a plurality of cutting blanks, which define two segments, set at different side-rake orientations. More specifically cutting blanks 45, 46, 47 and 48 are arranged in a first segment extending from the outer peripheral base of the blade along the outer edge thereof to a point above the tip of the blade. These cutting blanks, as shown, are all oriented at an outward side-rake angle. The remaining cutting blanks on blade 15, which include cutting blanks 49, 50 and 51 at the tip and the inner-edge cutting blanks extending up to blank 52 define a second segment of the blade. All of the cutting blanks within this second segment are oriented at an inward side rake angle.

All of the cutting blanks on blade 20, which is one of the shortened blades of the second array, are oriented in an outward side-rake direction. Thus, the side rake orientation of the cutting blanks 54, 55 and 56 at the tip of blade 20 is opposite to the side rake orientation of the cutting blanks 49, 50 and 51 at the tip of blade 15.

As explained in greater detail hereinafter, each of the remaining blades in the first array conforms to the configuration of blade 15 shown in FIG. 3 and each of the remaining blades in the second array conforms to the configuration of blade 20. Thus, returning to FIG. 2, it can be seen that the side-rake directions of the cutting blanks at the tips of the alternate blades of the bit as shown in FIG. 2 are opposed. The cutting blanks located on the first array blade are positioned similarly along the edges so that they cut in a common set of tracks. The cutting blanks on the second-array blades are similarly situated, but as indicated in FIG. 3, the tracks cut by the second-array blades are at least partially different from and compliment the tracks cut by the blades of the first array. More specifically, as shown in FIG. 3, the tracks of cutting blanks 57, 58, 59 and 60 on blade 20 are the same as the tracks of cutting blanks 45, 46, 47 and 48 respectively on blade 15. However, the cutting surface of blanks 54, 55 and 56 are laterally offset on blade 20 relative to the location of the cutting surfaces of blanks 49, 50 and 51, respectively, on blade 15 and thus cut in a different set of tracks.

The drilling fluid flow system of the bit is also illustrated in greater detail in FIG. 3. As there illustrated the drilling fluid discharge passageway 27*a* extends slightly outwardly at the discharge port 27 so that the stream of fluid is directed outwardly as well as downwardly, although it is in the predominantly downward direction. The baffle members extend downwardly to terminal locations adjacent to and immediately above the tips of the blades as indicated by baffle members 38 and 41. This directs the flow of drilling fluid against the cutting blanks at the tips of the blades and in addition results in an increased pressure differential across the bit upon sustained wear of the blade tips. In this regard, from examination of FIG. 3, it can be recognized that as the tip of blade 15 wears the cross sectional area below the baffle member 38 between the lower end of the baffle member and the bottom face of the borehole open to fluid flow will be decreased. The resulting pressure differential can be sensed at the surface to determine when pronounced bit wear takes place.

The return drilling fluid passages, as exemplified by passageway 33*a*, extend upwardly and outwardly from an enlarged return chamber 62 formed along the central axis of the bit and above the point of convergence of the full blades. The chamber 62 acts as a collecting point for the return drilling fluid and the cuttings entrained therein prior to distribution into the borehole annulus. It will be noted that the total cumulative cross-sectional flow area of the return passages is greater than the total cumulative cross-sectional area of the drilling fluid supply ports in order to accommodate removal of the increased volume of drilling fluid resulting from the cuttings generated by the bit.

Figure 4:
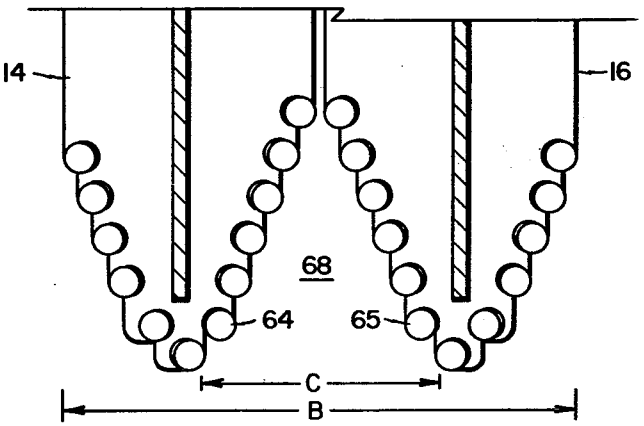
FIG. 4 is a side elevational view of the bottom portion of the bit as taken along line 4—4 in FIG. 2 to show the relationship of the blades in the first array and the core volume defined thereby.

Turning now to FIG. 4 there is illustrated a side elevational view of the bottom portion of the bit taken generally along lines 4—4 of FIG. 2. Thus FIG. 4 shows the center cutting blades 14 and 16 of the first array as though they were opposing each other in a common plane. The location and side rake orientation of the cutting blanks along the edges of the respective blades is identical to that described previously with respect to blade 15 shown in FIG. 3. Thus each set of corresponding cutting blanks cuts in the same track. For example, cutting blanks 64 and 65 are located on blades 14 and 16 respectively similarly as the cutting blank 51 on blade 15 (FIG. 3) so that the three cutting blanks cut in a common track. The convergence of the inner edges of the blades in the first array define a conically shaped core volume, indicated by reference numeral 68, at the bottom of the bit.

Figure 5:
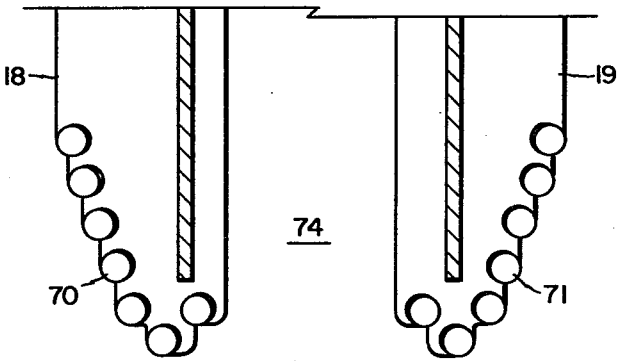
FIG. 5 is a side elevational view of the bottom portion of the bit as taken along line 5—5 in FIG. 2 to show the relationship of the blades in the second array and the core volume defined thereby.

FIG. 5 is a view similar to FIG. 4, but taken generally along lines 5—5 of FIG. 2 to show the cutting profile of the blades 18 and 19 in the second blade array. As shown in FIG. 5, each set of corresponding cutting blanks in the second array have the same cutting track. For example, blanks 70 and 71 on blades 18 and 19, respectively, cut in the same track as the cutting blank 60 of blade 20 shown in FIG. 3. As is evident from an examination of FIG. 5, the cutting profiles of the second array of blades define a cylindrical core volume 74 which is substantially greater than the conical core volume defined by the center cutting blades of the first array. The relationship of the cutting profiles of the blades within each array and the cutting profiles of the two arrays enhance the stability of the bit while retarding the tendency of over-drilling. Preferably the radial distance (as measured through the center of the bit) between the tips of the blades in the first array is at least one-third of the gauge diameter of the bit. Thus, as indicated in FIG. 4, the dimension "C" at the bottom of the core volume defined by the blades 14 and 16 is one-third or more of the overall gauge diameter of the bit indicated by dimension "B". It is also preferred from the viewpoint of bit stability that the inner edges of the blades in the first array converge upwardly at a slope of at least 2:1. In general the steeper the slope, and thus the greater amount of core volume provided, the more stable the bit will be during drilling operations.

As noted previously, the cutting blanks at the tips of the second-array blades cut in tracks which are different from the tracks of the corresponding cutting blanks at the tips of the first-array blades. However, the remaining cutting blanks along the outer edges of the second-array blades, as exemplified by cutting blanks 57 through 60 in FIG. 3, cut in the same set of tracks as the corresponding cutting blanks along the outer edges of the first array blades. The rate of penetration per blade along the outer portion of the borehole is one-half of the rate of penetration per blade for the central core area of the borehole. Thus in the embodiment illustrated the penetration per blade along the outer portion of the borehole is one-sixth of the penetration of the bit in one revolution whereas along the central core portion of the borehole the penetration per blade is one-third of the bit penetration.

An alternative to the configuration shown in FIG. 3 may be employed in which the cutting blanks along the outer edges of the second-array blades cut in different but complimentary tracks relative to the cutting blanks along the outer edges of the first-array blades. For example, and with reference to FIG. 3, the configuration of blade 20 may be changed slightly so that each of cutting blanks 57 through 60 is moved downward and inward slightly by a dimension of one-half the cutting blank diameter. Corresponding adjustments would also be made in the blades 18 and 19 with the result that the bit would cut a relatively smooth surface at the outer cutting face of the borehole. This is of particular advantage where there is a relatively small pressure drop across the bit, such as in the case where a downhole turbine motor is employed. In this case, most of the downhole pressure gradient is employed in operation of the drill motor with a relatively small pressure drop of perhaps 200–400 psi occurring through the bit itself. This usually results in the drilling fluid being in laminar flow along the outer edges of the blades and the relative smoothness of the cutting face facilitates removal of debris therefrom during the drilling operation.

In most bits constructed in accordance with the present invention it will be convenient and desirable to employ six cutting blades as described previously. However, a larger or smaller number of cutting blades can be employed. For example, in relatively small diameter bits, space limitations may require that the bit comprise only four blades, two in each array. In relatively large bits of perhaps 11 to 12 inches in diameter, two arrays of 4 blades each may be employed.

Having described specific embodiments of the present invention, it will be understood that modifications thereof may be suggested to those skilled in the art, and it is intended to cover all such modifications as fall within the scope of the appended claims.

What is claimed is:

1. In a rotary earth drilling bit, the combination comprising:

a body portion adapted to be secured to a rotary drill member, a first array of radially divergent blades depending from said body portion, said blades having outer edges which taper upwardly and outwardly from their tips to the periphery of said bit and inner edges which taper upwardly and inwardly and converge at the axis of said bit to define a conically shaped core volume at the bottom of said bit, a plurality of cutting blanks having upset cutting surfaces spaced along the outer and inner edges of said blades and oriented at a side rake angle relative to said blades, a second array of radially divergent blades depending from said body portion and interposed between the blades of said first array, the blades of said second array having outer edges which conform generally to the outer edges of said first array blades and having inner edges which terminate at locations radially spaced from the axis of said bit to define a core volume which is greater than the core volume defined by the first array of blades, and a plurality of cutting blanks having upset cutting surfaces located along the outer edges and tips of said second array blades, at least some of said cutting blanks oriented at a side rake angle which is opposed with respect to the side rake angle of the corresponding cutting blanks on said first array blades.

2. The combination of claim 1 further comprising a plurality of drilling fluid supply passageways extending downwardly through said body member and terminating in ports which are between said blades and radially offset from the axis of said bit, means providing for fluid communication between the top of said bit and the bottom of said body portion at the convergence of said first array blades, and baffle means interposed between said ports and the convergence of said first array blades for directing the flow of fluid discharged from said ports downwardly along the outer edges of said blades and thence upwardly along the inner edges of said blades.

3. The combination of claim 2 wherein said bit further comprises an annular baffle surrounding said bit above said ports and having substantially the same gauge as the cutting gauge of said bit.

4. The combination of claim 1 wherein the cutting blanks located on said first array of blades are positioned to cut in a first set of tracks and the cutting blanks located on said second array of blades are positioned to cut in a second set of tracks at least partially different from and complimenting said first set of tracks.

5. The combination of claim 1 wherein the cutting blanks on the second array of blades and an upper portion of the cutting blanks on the first array of blades are oriented in the same side-rake direction and a lower portion of cutting blanks on the peripheral edges and tips of said first array of blades are oriented in an opposed side-rake direction whereby the side rake directions of cutting blanks at the tips of alternate blades of said bit are opposed.

6. The combination of claim 1 wherein the blades in said first array have a first common segment extending from the base of said blades along the outer edges thereof to a point above the tips of said blades and a second common segment extending from the bottom of said first segment along the outer edges, and tips and inner edges of said blades, and wherein the cutting blanks located within the first segment are oriented at an outward side rake, the cutting blanks located within said second segment are oriented at an inward side rake, and the cutting blanks on the second array of blades are oriented at an outward side rake.

7. The combination of claim 1 wherein the radial distance between the tips of said blades in said first array is at least one-third of the gauge diameter of said bit.

8. The combination of claim 7 wherein the inner edges of said first array blades converge at an upward slope of at least 2/1.

9. In a rotary earth drilling bit, the combination comprising:

a body portion adapted to be secured to a rotary drill member, a plurality of wedge-shaped radially divergent blades depending from said body portion, the inner edges of said blades tapering upwardly and inwardly from their tips to convergence at the axis of said bit, a plurality of cutting blanks having upset cutting surfaces located along the inner and outer edges of said blades, means providing for fluid communication through the interior of said body portion between the top of said bit and the bottom of said body portion at the convergence of said blades, and a plurality of drilling fluid supply passageways extending downwardly through said body member and terminating in ports at locations radially offset from the axis of said bit whereby drilling fluid discharged from said ports flows downwardly along the outer edges of said blades and thence inwardly to the convergence of said blades and said fluid communication means.

10. The combination of claim 9 further comprising baffle means extending downwardly from said body portion and interposed between said ports and the convergence of said blades.

11. The combination of claim 9 further comprising an annular baffle on said bit above said ports and having substantially the same gauge as the cutting gauge of said bit.

12. The combination of claim 9 further comprising a second array of radially divergent blades depending from said body portion and interposed between said first recited blades, said second array blades having inner edges which terminate at locations radially spaced from the axis of said bit, and a plurality of cutting blanks having upset cutting surfaces along the outer peripheral edges of said second array blades.

13. The combination of claim 12 further comprising a plurality of baffle ribs connected between adjacent blades and extending downwardly from said body portion at positions interposed between said ports and the convergence of said first recited blades.

14. The combination of claim 13 wherein said baffle ribs extend downwardly to terminal locations adjacent to and above the tips of said blades.

15. The combination of claim 13 wherein said fluid communication means comprises an enlarged return chamber in said bit above the convergence of said first array blades and a plurality of return passages extending from said chamber upwardly and outwardly to the exterior of said bit.

16. In a rotary earth drilling bit, the combination comprising:

a body portion adapted to be secured to a rotary drill member, a first array of radially divergent blades depending from said body portion, said blades having outer edges which taper upwardly and outwardly from their tips to the periphery of said bit and inner edges which taper upwardly and inwardly and converge at the axis of said bit to define a conically shaped core volume at the bottom of said bit, a plurality of cutting blanks having upset cutting surfaces spaced along the outer and inner edges and tips of said blades and positioned on said blades to cut in a common set of tracks, a second array of radially divergent blades depending from said body portion and interposed between the blades of said first array, the blades of said second array having outer edges which conform generally to the outer edges of said first array blades and having inner edges which terminate at locations radially spaced from the axis of said bit to define a core volume which is greater than the core volume defined by the first array of blades, and a plurality of cutting blanks having upset cutting surfaces located along the outer edges and tips of the blades of said second array and positioned thereon to cut in a second common set of tracks which are at least partially different from and compliment said first recited set of tracks, a plurality of drilling fluid supply passageways extending downwardly through said body member and terminating in ports between said blades and radially offset from the axis of said bit, means providing for fluid communication between the top of said bit and the bottom of said body portion at the convergence of said first array blades, and baffle means interposed between said ports and the convergence of said first array blades for directing the flow of fluid discharged from said ports downwardly along the outer edges of said blades and thence upwardly along the inner edges of said blades to said fluid communication means.

17. The combination of claim 16 wherein the cutting blanks at the tips of said first array blades are oriented in a designated side-rake direction and the cutting blanks at the tips of said second array blades are oriented in an opposed side-rake direction relative to said first side rake direction.

18. The combination of claim 16 wherein the blades in said second array each have at least one cutting blank located on the inner edge near the blade tip and wherein the three lower-most cutting blanks on the blades of said first array are oriented in an inward side rake direction and the three lower-most cutting blanks on the blades of said second array are oriented in an outward side rake direction.

19. The combination of claim 16 wherein said bit further comprises an annular baffle surrounding said bit above said ports and having substantially the same gauge as the cutting gauge of said bit.

20. The combination of claim 16 wherein the blades in said first array have a first common segment extending from the base of said blades along the outer edges thereof to a point above the tips of said blades and a second common segment extending from the bottom of said first segment along the outer edges, and tips and inner edges of said blades, and wherein the cutting blanks located within the first segment are oriented at an outward side rake, the cutting blanks located within said second segment are oriented at an inward side rake, and the cutting blanks on the second array of blades are oriented at an outward side rake.

21. The combination of claim 16 wherein the radial distance between the tips of said blades in said first array is at least one-third of the gauge diameter of said bit.

22. The combination of claim 21 wherein the inner edges of said first array blades converge at an upward slope of at least 2/1.

23. The combination of claim 16 wherein said baffle means comprises a plurality of baffle ribs connected between adjacent blades and extending downwardly from said body portion at positions interposed between said ports and the convergence of the blades in said first array.

24. The combination of claim 23 wherein said fluid communication means comprises an enlarged return chamber in said bit above the convergence of said first array blades and a plurality of return passages extending from said chamber upwardly and outwardly to the exterior of said bit.

* * * * *